US008177526B2

(12) United States Patent
Dowling et al.

(10) Patent No.: US 8,177,526 B2
(45) Date of Patent: May 15, 2012

(54) GAS WELL DEWATERING SYSTEM

(75) Inventors: Michael A. Dowling, Houston, TX (US); Jason Kamphaus, Missouri City, TX (US); Harryson Sukianto, Missouri City, TX (US); Alain P. Dorel, Houston, TX (US); John David Rowatt, Pearland, TX (US); Arthur I. Watson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 581 days.

(21) Appl. No.: 12/388,098

(22) Filed: Feb. 18, 2009

(65) Prior Publication Data

US 2010/0209265 A1 Aug. 19, 2010

(51) Int. Cl.
*E21B 43/00* (2006.01)

(52) U.S. Cl. ..... 417/393; 417/404; 417/505

(58) Field of Classification Search ..... 417/390, 417/393, 505, 404

See application file for complete search history.

(56) References Cited

U.S. PATENT DOCUMENTS

| | | | |
|---|---|---|---|
| 2,708,411 | A | 5/1955 | Richardson |
| 2,834,300 | A | 5/1955 | Brock |
| 2,941,629 | A | 6/1960 | Rohacs |
| 3,183,972 | A | 5/1965 | Fredd |
| 3,589,838 | A | 6/1971 | Tuzson |
| 3,912,009 | A | 10/1975 | Davis, Jr. |
| 4,043,390 | A | 8/1977 | Glotin |
| 4,184,515 | A | 1/1980 | Streich et al. |
| 4,317,485 | A | 3/1982 | Ross |
| 4,598,630 | A | 7/1986 | Kao |
| 4,688,999 | A | 8/1987 | Ames et al. |
| 5,188,517 | A | 2/1993 | Koster |
| 5,203,172 | A | 4/1993 | Simpson et al. |
| 5,229,017 | A | 7/1993 | Nimerick et al. |
| 5,577,890 | A | 11/1996 | Nielsen et al. |
| 5,778,978 | A | 7/1998 | Crow |

(Continued)

FOREIGN PATENT DOCUMENTS

GB 2099043 A 12/1982

(Continued)

OTHER PUBLICATIONS

Dowling, Michael A. et al, "Overpressure Protection in Gas Well Dewatering Systems", U.S. Appl. No. 12/372,962, filed Feb. 18, 2009.

(Continued)

*Primary Examiner* — Karabi Guharay
(74) *Attorney, Agent, or Firm* — Jim D. Patterson

(57) ABSTRACT

Power and control logic configurations for gas well dewatering systems are provided. In one example, a reservoir is configured to contain hydraulic, lubricating fluid. An electric motor is configured to receive fluid from the reservoir for lubrication and a hydraulic pump powered by the electric motor is configured to receive fluid from the reservoir and pump the fluid into a hydraulic circuit. A positive displacement oscillating pump is powered by the hydraulic pump and configured to pump fluid from the reservoir to an outlet from the well. The electric motor and hydraulic pump receive the same fluid from the reservoir for lubrication and to create pressure in the hydraulic circuit, respectively. A switching device is connected to the hydraulic circuit and is switchable between a first position wherein fluid pressure from the hydraulic pump causes the piston pump to move in a first direction and a second position wherein fluid pressure from the hydraulic pump causes the piston pump to move in a second direction.

36 Claims, 4 Drawing Sheets

U.S. PATENT DOCUMENTS

| | | | |
|---|---|---|---|
| 5,871,051 | A | 2/1999 | Mann |
| 5,961,841 | A | 10/1999 | Bowers |
| 6,000,468 | A | 12/1999 | Pringle |
| 6,017,198 | A | 1/2000 | Traylor et al. |
| 6,044,909 | A | 4/2000 | Gano |
| 6,069,118 | A | 5/2000 | Hinkel et al. |
| 6,089,322 | A | 7/2000 | Kelley et al. |
| 6,140,277 | A | 10/2000 | Tibbles et al. |
| 6,140,817 | A | 10/2000 | Flaum et al. |
| 6,196,309 | B1 | 3/2001 | Estilette, Sr. |
| 6,508,310 | B1 | 1/2003 | Mioduszewski et al. |
| 6,569,814 | B1 | 5/2003 | Brady et al. |
| 6,638,896 | B1 | 10/2003 | Tibbles et al. |
| 6,660,693 | B2 | 12/2003 | Miller et al. |
| 6,720,290 | B2 | 4/2004 | England et al. |
| 6,837,309 | B2 | 1/2005 | Boney et al. |
| 6,854,515 | B2 | 2/2005 | Matthews et al. |
| 6,915,854 | B2 | 7/2005 | England et al. |
| 6,964,299 | B2 | 11/2005 | Scarsdale |
| 7,005,765 | B1 | 2/2006 | Schulz et al. |
| 7,124,819 | B2 | 10/2006 | Ciglenec et al. |
| 7,380,608 | B2 | 6/2008 | Geier |
| 7,726,404 | B2 | 6/2010 | Kubala et al. |
| 2004/0060705 | A1 | 4/2004 | Kelley |
| 2004/0084178 | A1 | 5/2004 | Reid |
| 2006/0083645 | A1 | 4/2006 | Simmons |
| 2007/0023191 | A1 | 2/2007 | Dreggevik |
| 2007/0110597 | A1 | 5/2007 | Traylor et al. |
| 2007/0227732 | A1 | 10/2007 | Miller et al. |
| 2007/0251704 | A1 | 11/2007 | Reimert et al. |
| 2009/0217992 | A1 | 9/2009 | Wilson |
| 2010/0096129 | A1 | 4/2010 | Hinkel et al. |
| 2010/0206544 | A1 | 8/2010 | Dowling et al. |
| 2010/0206549 | A1 | 8/2010 | Dowling et al. |
| 2010/0206568 | A1 | 8/2010 | Dowling et al. |
| 2010/0209265 | A1 | 8/2010 | Dowling et al. |
| 2010/0211226 | A1 | 8/2010 | Dowling et al. |

FOREIGN PATENT DOCUMENTS

| | | | |
|---|---|---|---|
| GB | 2339914 | A | 2/2000 |
| GB | 2436576 | A | 10/2007 |
| GB | 2457784 | A | 9/2009 |
| WO | 2010096303 | A1 | 8/2010 |
| WO | 2010096431 | A1 | 8/2010 |
| WO | 2010096481 | A1 | 8/2010 |

OTHER PUBLICATIONS

Dowling, Michael A. et al, "Monitoring and Control System for a Gas Well Dewatering Pump", U.S. Appl. No. 12/388,542, filed Feb. 19, 2009.

Dowling, Michael A. et al, "Devices, Systems, and Methods for Equalizing Pressure in a Gas Well", U.S. Appl. No. 12/388,211, filed Feb. 18, 2009.

Dowling, Michael A. et al, "Integrated Cable Hanger Pick-Up System", U.S. Appl. No. 12/388,323, filed Feb. 18, 2009.

GAS WELL DEWATERING SYSTEM

FIELD

The present application relates generally to gas well dewatering systems. More particularly, the present application relates to power and control logic configurations for positive displacement oscillating pumps used in gas well dewatering systems.

BACKGROUND

Hydrocarbons and other fluids are often contained within subterranean formations at elevated pressures. Wells drilled into these formations allow the elevated pressure within the formation to force the fluids to the surface. However, in low pressure formations, or when the formation pressure has diminished, the formation pressure may be insufficient to force the fluids to the surface. In these cases, a positive displacement pump, such as a piston pump, can be installed to provide the required pressure to produce the fluids.

The function of pumping systems in gas wells is to produce liquid, generally water, that enters the wellbore naturally with the gas. This is necessary only on low flow rate gas wells. In high flow rate gas wells, the velocity of the gas is sufficient that it carries the water to surface. In low flow rate wells, the water accumulates in the wellbore and restricts the flow of gas. By pumping out the water, the pump allows the well to flow at a higher gas rate, and this additional produced gas, which eventually is related to additional revenue, pays for the pumping unit.

The use of a retrievable pumping system in a low-flow rate gas well is subject to several economic restrictions. One principal restriction is that the pumping system must be inexpensive to replace, otherwise the cost of installing or replacing the unit overwhelms the additional revenue from an increase in the low flow rate of gas.

SUMMARY

The present disclosure recognizes that it is desirable to provide a gas well dewatering system that is of sufficiently small size that it can be deployed and operated in a relatively crowded well environment. It is recognized as desirable to provide such a system that is durable and yet relatively inexpensive to manufacture, operate and repair.

In one example, a gas well dewatering system is configured to pump well fluid from a reservoir to an outlet for discharge from a well. The system includes a reservoir configured to contain hydraulic, lubricating fluid; an electric motor configured to receive fluid from the reservoir for lubrication; a hydraulic pump powered by the electric motor, the hydraulic pump configured to receive fluid from the reservoir and pump said fluid into a hydraulic circuit; and a positive displacement pump powered by the hydraulic pump and configured to pump fluid from the reservoir to the outlet. Advantageously, the electric motor and hydraulic pump receive the same fluid from the reservoir for lubrication and for pumping into the hydraulic circuit, respectively. According to this arrangement, it is possible for the motor and hydraulic pump to rotate in one direction while the positive displacement pump oscillates to pump fluid from the well.

In another example, a switching device is connected to the hydraulic circuit and is switchable between a first position wherein fluid pressure in the hydraulic circuit is applied to the first side of the piston pump to move the piston pump in a first direction and a second position wherein fluid pressure in the circuit is applied to the second side of the piston pump to move the piston pump in a second, opposite direction. The movement of the piston pump in the first direction causes corresponding movement of the switching device into the second position. Movement of the piston pump in the second direction causes corresponding movement of the switching device into the first position. In a preferred example, the piston pump and the switching device are coupled together.

In another example, a first hydraulic circuit is configured to convey fluid pressure from the hydraulic pump to power the piston pump and a second hydraulic circuit is configured to convey fluid pressure to a switching device switchable between a first position wherein fluid pressure in the first hydraulic circuit is applied to the first side of the piston pump to move the piston pump in the first direction and a second position wherein fluid pressure in the first hydraulic circuit is applied to the second side of the piston pump to move the piston pump in the second direction. Movement of the piston pump in the first direction causes the switching device to switch to the second position. Movement of the piston pump in the second direction causes the switching device to switch to the second position.

BRIEF DESCRIPTION OF THE DRAWINGS

The best mode of practicing the invention is described hereinbelow with reference to the following drawing figures.

DETAILED DESCRIPTION OF THE DRAWINGS

In the following description, certain terms have been used for brevity, clearness, and understanding. No unnecessary limitations are to be implied therefrom beyond the requirement of the prior art because such terms are used for descriptive purposes only and are intended to be broadly construed. The different systems described herein may be used alone or in combination with other systems. It is to be expected that various equivalents, alternatives, and modifications are possible within the scope of the appended claims.

Figure 1:
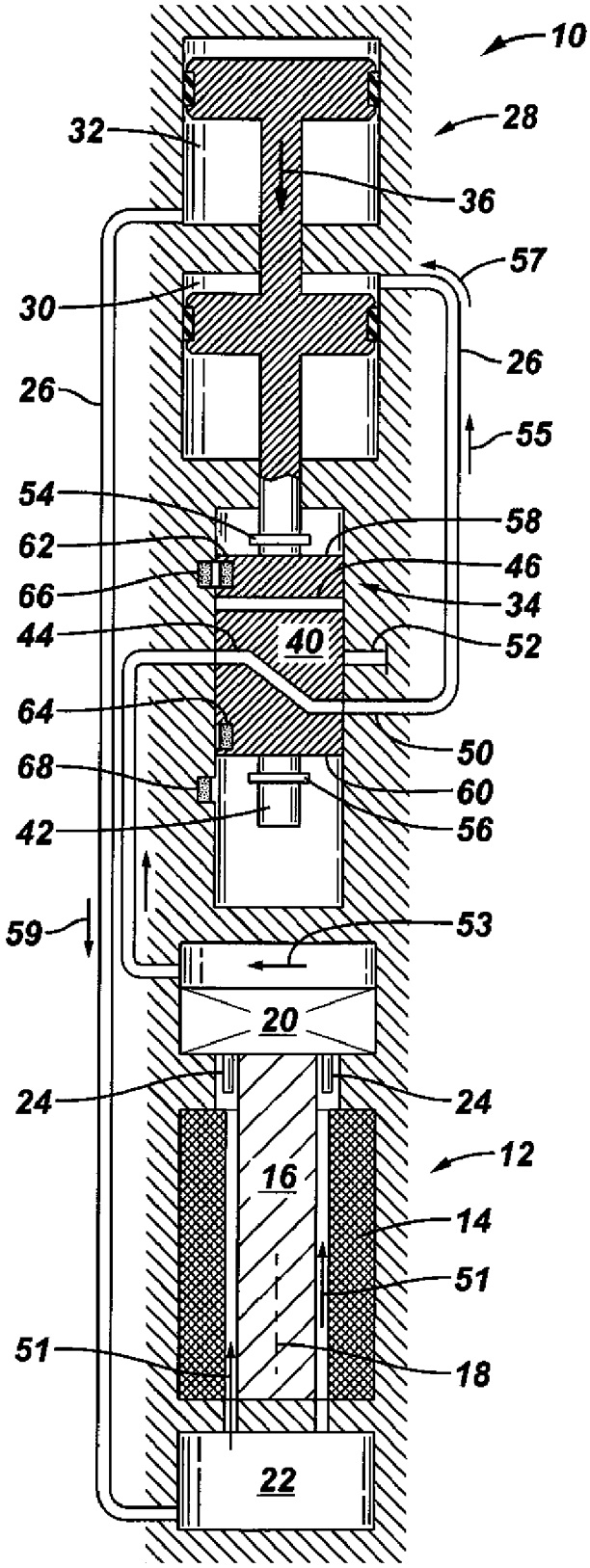
FIG. 1 depicts a gas well dewatering system including a reservoir, electric motor, hydraulic pump, hydraulic circuit, positive displacement oscillating pump, and switching device switched into a first position.
Figure 2:
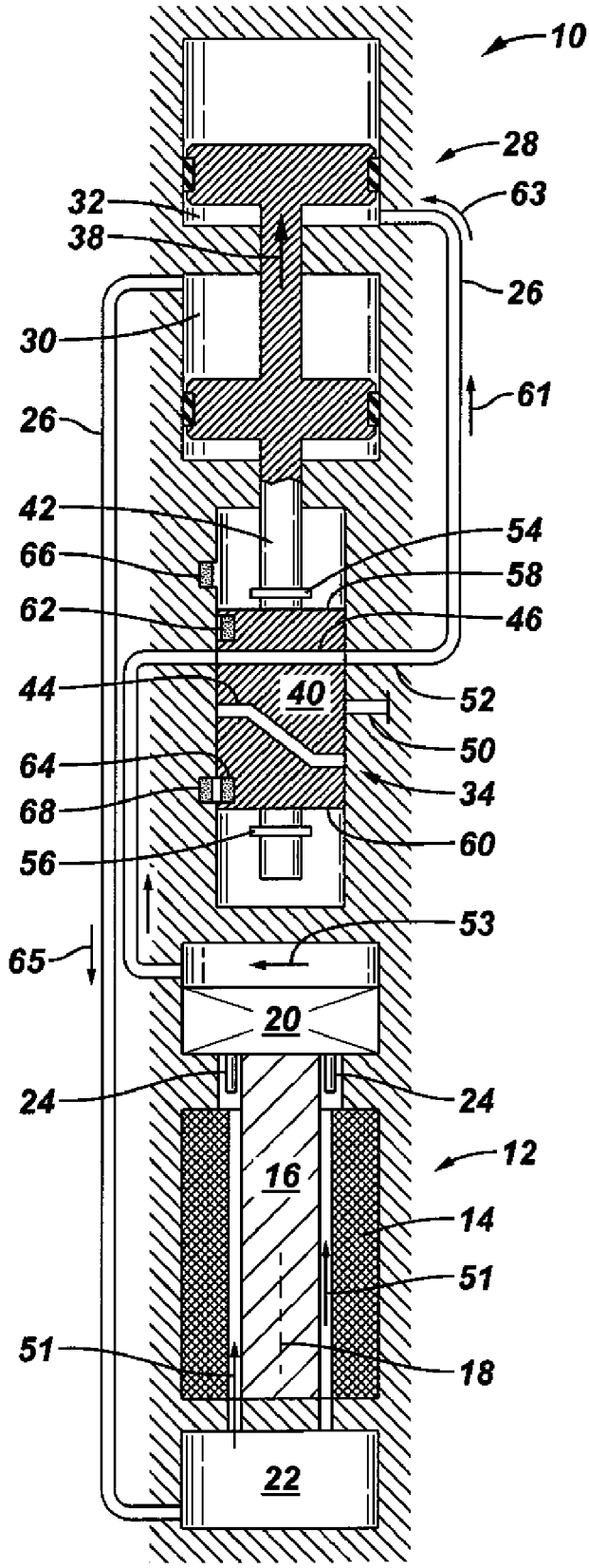
FIG. 2 depicts the system depicted in FIG. 1 wherein the switching device is switched into a second position.

FIGS. 1 and 2 depict a gas well dewatering system 10 configured to be inserted into a well and to pump fluid from the well. The gas well dewatering system 10 includes an electric motor 12 including a stator 14 and rotor 16 configured to rotate in one direction about a rotational axis 18 and provide power to a hydraulic pump 20. The electric motor 12 can be powered by conventional means, such as via a power cable extending from the surface of the well.

A fluid reservoir 22 contains dual purpose fluid suitable for lubrication and as a hydraulic fluid. Fluid from the reservoir 22 is supplied to the motor 12 for lubrication and then via conduits 24 to the hydraulic pump 20. The hydraulic pump 20 is configured to pump the fluid into a hydraulic circuit 26 to power oscillating movement of a positive displacement pump 28. In the example shown, the positive displacement pump 28 is a dual acting piston pump and the hydraulic circuit 26 conveys fluid pressure from the hydraulic pump 20 selectively to first 30 and second 32 sides of the dual acting piston pump 28.

A switching device 34 is connected to the hydraulic circuit 26 and configured to switch between a first position, shown in FIG. 1, wherein fluid pressure from the hydraulic pump 20 causes the dual acting piston pump 28 to move in a first direction shown by arrow 36 and a second position, shown in FIG. 2, wherein fluid pressure from the hydraulic pump 20 causes the dual acting piston pump 28 to move in a second direction shown by arrow 38. In the example shown, the first direction 36 is a downward motion and the second direction 38 is an upward motion. Such operation of the switching device 34 advantageously allows the electric motor 12 to turn in a single direction about rotational axis 18 while the dual acting piston pump 28 completes a reciprocating or oscillating movement in the first and second directions 36, 38, as will be described further below.

In the example shown, the switching device 34 has a switch body 40 that is coupled to an extension rod 42 extending from the dual acting piston pump 28. The switch body 40 has a first through-bore 44 configured to align with the hydraulic circuit 26 when the switching device 34 is in the first position shown in FIG. 1, and a second through-bore 46 configured to align with the hydraulic circuit 26 when the switching device 34 is in the second position, shown in FIG. 2. The hydraulic circuit 26 includes a hydraulic input 48 that aligns with the first through-bore 44 in the switch body 40 when the switch body 40 is in the first position, shown in FIG. 1. The hydraulic input 48 aligns with the second through-bore 46 in the switch body 40 when the switch body 40 is in the second position, shown in FIG. 2. The hydraulic circuit 26 further includes a first hydraulic output 50 that aligns with the first through-bore 44 on the switch body 40 when the hydraulic circuit 26 is in the first position, shown in FIG. 1. In the first position, the hydraulic circuit 26 conveys fluid pressure from the hydraulic pump 20 to the first side 30 of the dual acting piston pump 28. The hydraulic circuit 26 includes a second hydraulic outlet 52 that aligns with the second through-bore 46 when the hydraulic circuit 26 is in the second position, shown in FIG. 2. In the second position, the hydraulic circuit 26 conveys fluid pressure from the hydraulic pump 20 to the second side 32 of the dual acting piston pump 28.

The extension rod 42 which extends from the dual acting piston pump 28 includes a top flange 54 and a bottom flange 56 configured to engage with the top side 58 and bottom side 60 of the switch body 40, respectively. Dynamic magnets 62, 64 are coupled to the switch body 40 and stationary magnets 66, 68 are coupled to, for example, a housing associated with the system 10. The stationary magnets 66, 68 are spaced apart and respectively configured to attract at least one of the dynamic magnets 62, 64 and thereby cause the switch body 40 to firmly register into one of the first and second positions shown in FIGS. 1 and 2, respectively.

During operation, electric power is provided to motor 12, which causes rotor 16 to rotate and provide power to hydraulic pump 20. Fluid contained within reservoir 22 is conveyed to lubricate motor 12 during operation. Fluid continues through motor 12 (arrows 51) and is provided to hydraulic pump 20 wherein it is pumped into hydraulic circuit 26 (arrow 53) at a predetermined pressure sufficient to drive reciprocal motion of dual acting piston pump 28. Switching device 34 switches between the first position shown in FIG. 1 and the second position shown in FIG. 2 to provide fluid pressure to first and second sides 30, 32 of dual acting piston pump 28, respectively. More specifically, as shown in FIG. 1, switching device 34 is shown in the first position wherein fluid pressure is supplied from the hydraulic pump 20 via the first through-bore 44 to the first side 30 of the piston pump 28 (arrows 55, 57). Application of fluid pressure on the first side 30 of the dual acting piston pump 28 causes the dual acting piston pump 28 to move in the first direction 36. During said movement, the top flange 54 engages with the top side 58 of the switch body 40 and applies a sufficient force to overcome the attractive force between dynamic magnet 62 and stationary magnet 66, thus allowing the switch body 40 to move into the second position, shown in FIG. 2. During movement of the switch device 34, the dynamic magnet 64 and stationary magnet 68 are brought into proximity with each other such that an attractive force between the respective magnets 64, 68 causes the switch body 40 to register or snap into place in the second position, shown in FIG. 2. During movement of piston pump 28 in the first direction 36, fluid is pumped from the second side 32 of the pump 28 back to the reservoir 22 (arrow 59).

While in the second position, fluid pressure from the hydraulic pump 20 is applied to the second side 32 of the dual acting piston pump 28 via the hydraulic circuit 26 and specifically through the through-bore 46. Application of pressure to the second side 32 of the dual acting piston pump 28 (arrows 61, 63) causes the dual acting piston pump 28 to move in the second direction 38. During said movement, the bottom flange 56 engages with the bottom side 60 of the switch body 40 with sufficient pressure to overcome the attractive force between the magnets 64, 68, thus dislodging the switch body 40 from the second position and moving the switch body 40 in the second direction 38 such that the magnets 62, 66 are brought into proximity with each other. Attractive force between the respective magnets 62, 66 causes the switch body 40 to snap into the first position, shown in FIG. 1. During movement of piston pump 28 in the second direction 38, fluid is pumped from the first side 30 of the pump 28 back to the reservoir 22 (arrow 65).

The above process is repeated in succession and the dual acting piston pump 28 is powered to draw fluid from a well reservoir (not shown) and pump said fluid to an outlet (not shown) for discharge from the well.

Figure 3:
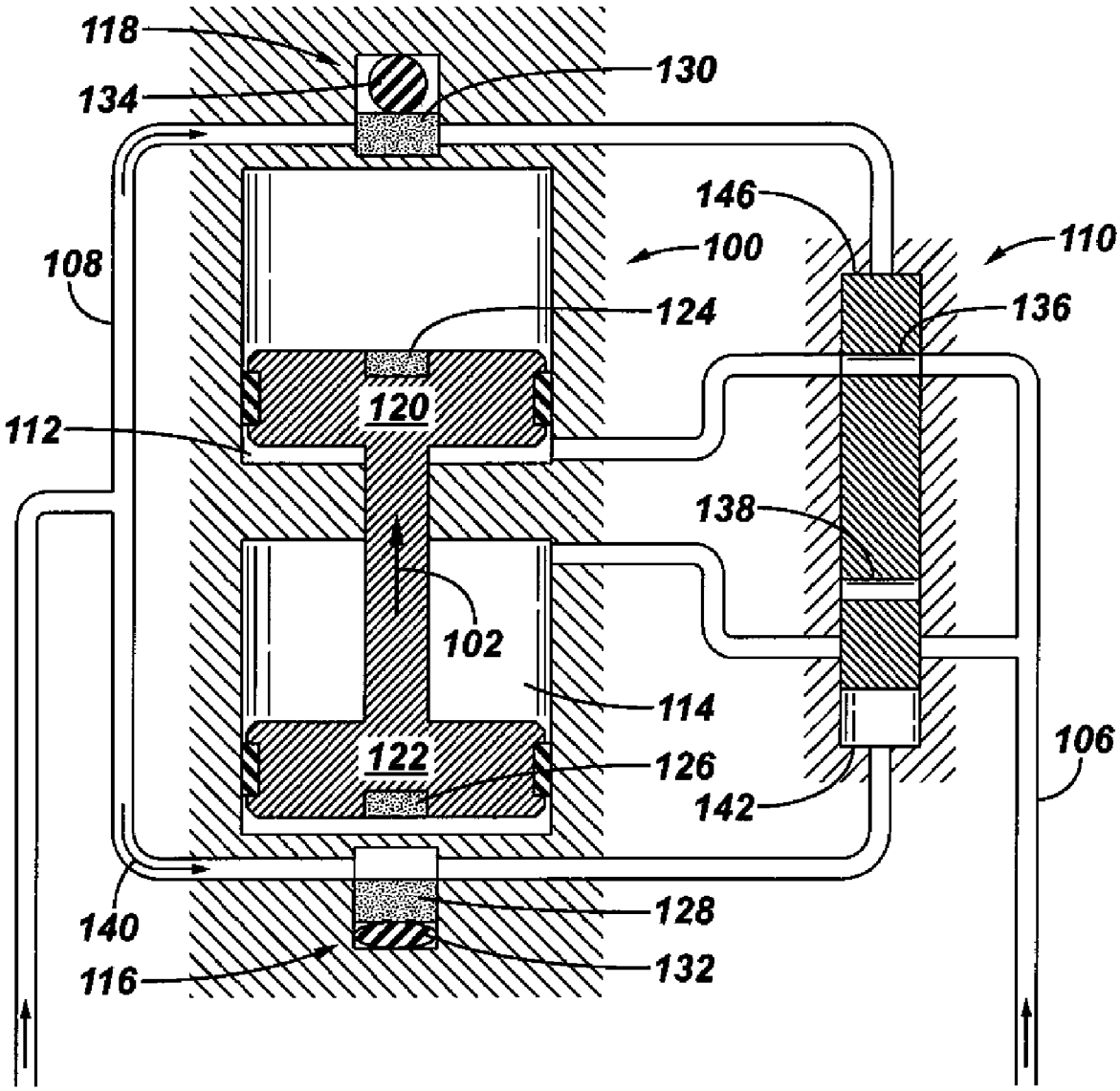
FIG. 3 is another example of a switching device, which is switched into a first position.
Figure 4:
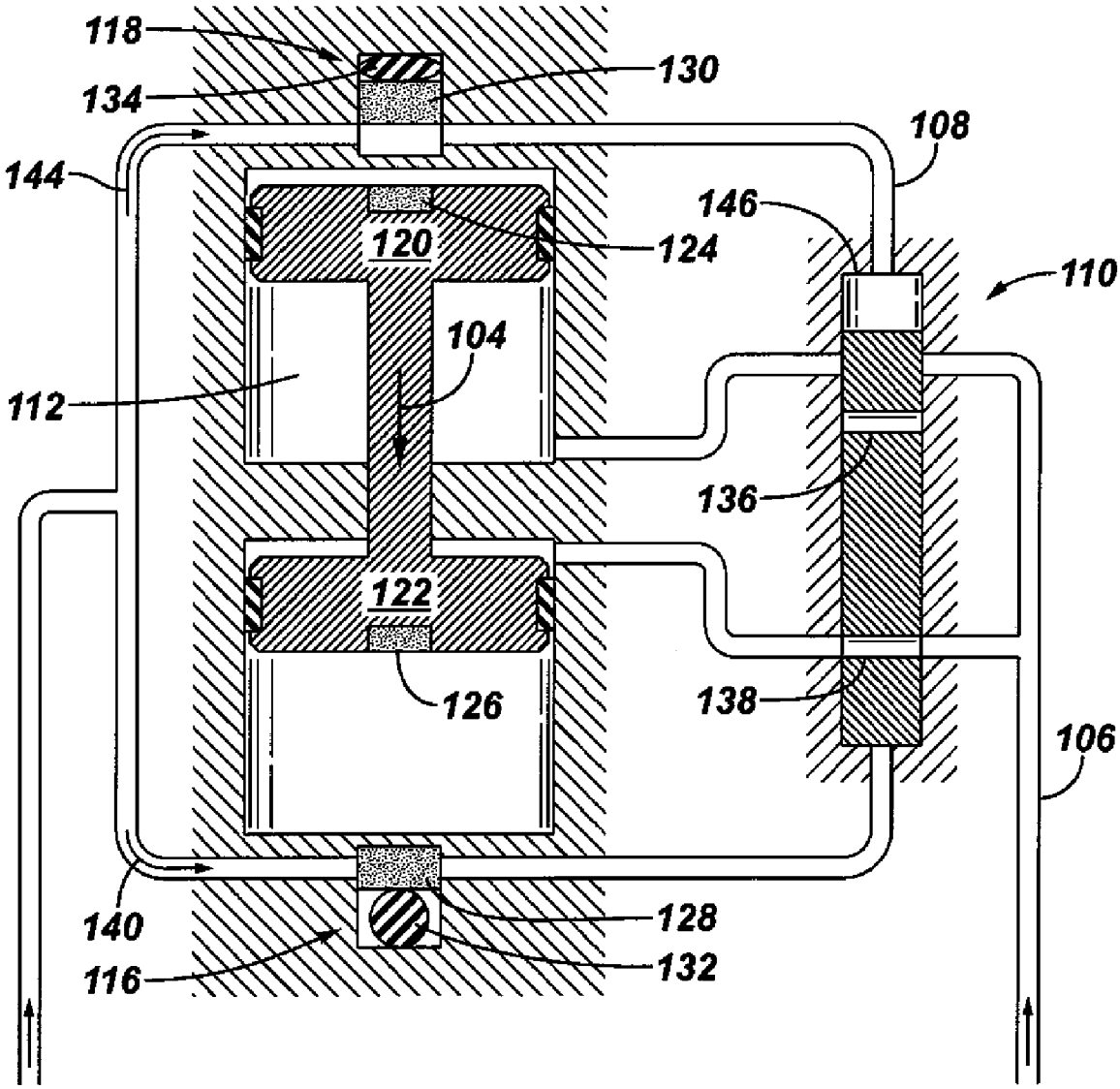
FIG. 4 depicts the switching device shown in FIG. 3, switched into a second position.

FIGS. 3 and 4 depict an alternate configuration for causing a reciprocating motion of a piston pump. In the example shown, a piston pump 100 is configured to reciprocate back and forth between first 102 and second 104 directions. A first hydraulic circuit 106 is configured to convey fluid pressure from a hydraulic pump (e.g. 20, see FIGS. 1 and 2) to power the piston pump 100. A second hydraulic circuit 108 is configured to convey fluid pressure to actuate a switching device 110, which in the example shown is a sliding spool switch switchable between a first position (FIG. 3) wherein fluid pressure in the first hydraulic circuit 106 is applied to a first side 112 of the piston pump 100 to move the piston pump 100 in the first direction 102 and a second position (FIG. 4) wherein fluid pressure in the first hydraulic circuit 106 is applied to a second side 114 of the piston pump 100 to move the piston pump 100 in the second direction 104. In the example shown, movement of the piston pump 100 in the first direction 102 causes the switching device 110 to switch to the second position (FIG. 4) and movement of the piston pump 100 in the second direction 104 causes the switching device 110 to switch to the first position (FIG. 3), as will be further described below.

In the example shown, a first switch 116 is disposed in the second hydraulic circuit 108. The first switch 116 is switchable between an open position (FIG. 3) wherein fluid pressure in the first hydraulic circuit 106 is applied to the first side 112 of the piston pump 100 to move the piston pump 100 in the first direction 102 in a closed position (FIG. 4) wherein fluid pressure in the first hydraulic circuit 106 is not applied to the first side 112 of the piston pump 100. A second switch 118 is disposed in the second hydraulic circuit 108. The second switch 118 is switchable between an open position (FIG. 4) wherein fluid pressure in the first hydraulic circuit 106 is allowed to apply to the second side 114 of the piston pump 100 to move the piston pump 100 in the second direction 104 and a closed position (FIG. 3) wherein fluid pressure in the first hydraulic circuit 106 is not applied to the second side 114 of the piston pump 100. As explained further below, movement of the piston pump 100 in the first direction 102 causes the first switch 116 to move into the closed position (FIG. 4), the second switch 118 to move into the open position (FIG. 4) and the switching device 110 to move into the second position (FIG. 4). Movement of the piston pump 100 in the second direction 104 causes the first switch 116 to move into the open position (FIG. 3), the second switch 118 to move into the closed position (FIG. 3), and the switching device 110 to move into the first position (FIG. 3).

In the example shown, the piston pump 100 includes upper and lower piston heads 120, 122. An upper magnet 124 is coupled to the upper piston head 120 and a lower magnet 126 is coupled to the lower piston head 122. In this example, the first switch 116 includes a first magnet 128, the second switch 118 includes a second magnet 130. The first switch 116 is biased into the closed position by an elastic element 132. The second switch 118 is also biased into the closed position by an elastic element 134. The upper magnet 124 is located proximate to the second magnet 130 when the piston moves in the first direction 102. The lower magnet 126 is located proximate the first magnet 128 when the piston moves in the second direction 104. Upper magnet 124 and second magnet 130 repulse each other. Lower magnet 126 and first magnet 128 repulse each other.

The sliding spool valve or switching device 110 has first and second passages 136, 138. The first passage 136 aligns with the first hydraulic circuit 106 to connect the hydraulic pump to the first side 112 of the piston pump 100 when the switching device 110 is in the first position (FIG. 3). The second passage 138 aligns with the hydraulic circuit 106 to connect the hydraulic pump to the second side 114 of the piston pump 100 when the switching device 110 is in the second position (FIG. 4).

During operation, hydraulic fluid pressure is provided to the hydraulic circuits 106, 108. When the piston pump 100 is in the first position (FIG. 3), the repulsive force between magnets 126 and 128 is sufficient to overcome the bias from elastic element 132 and cause the first switch 116 to open. Fluid pressure is thus allowed to flow in the direction of arrow 140 and apply to a first side 142 of switching device 110 to force the switching device 110 into a position wherein through-bore 136 is aligned with the hydraulic circuit 106 and in flow of fluid from circuit 106 is allowed to first side 112 of piston pump 100. This causes the piston pump 100 to move in the first direction 102. The fluid pressure applied to the first side 112 of the piston pump 100 is sufficient to move the piston pump in the first direction 102 towards the second switch 118 and into the position shown in FIG. 4. When the piston pump 100 reaches the position shown in FIG. 4, the repulsive force between magnets 112 and 130 is sufficient to overcome the bias provided by elastic member 134, thus opening the second switch 118 and allowing fluid flow through the hydraulic circuit 108 in the direction of arrow 144. Simultaneously, the elastic element 132 forces the magnet 128 and first switch 116 into the closed position shown in FIG. 4, thus preventing fluid flow through the hydraulic circuit 108 in the direction of arrow 140. Fluid pressure along arrow 144 is applied to a second side 146 of the switching device 110, thus forcing the switching device 110 into the position shown in FIG. 4 wherein conduit 138 is aligned with the hydraulic circuit 106 and inflow through hydraulic circuit 106 is allowed to the second side 114 of the piston pump 100. Inflow of fluid at the second side 114 of piston pump 100 causes the piston pump 100 to move in the second direction 104, back into the position shown in FIG. 3. As this occurs, the magnet 124 moves away from the magnet 130 and thus allows the bias pressure from elastic element 134 to cause the second switch 118 to move into the closed position shown in FIG. 3, thus preventing flow through the hydraulic circuit 108 along arrow 144.

The above-mentioned process occurs repeatedly allowing for oscillating movement of the piston pump 100 along directions 102 and 104.

What is claimed is:

1. A gas well dewatering system configured to pump well liquid to an outlet for discharge from the gas well, the gas well dewatering system comprising:

a hydraulic fluid reservoir, an electric motor, a hydraulic pump, and a positive displacement oscillating pump, each secured to form a cylindrical stack having a first diameter substantially smaller than a second diameter of the gas well, the cylindrical stack for insertion into and retrieval from the gas well;

the hydraulic fluid reservoir in fluid communication with the electric motor and configured to transfer the hydraulic, lubricating fluid through an interior of the electric motor to the hydraulic pump for powering the positive displacement oscillating pump;

the electric motor having the interior configured to receive the hydraulic, lubricating fluid from the hydraulic fluid reservoir for lubrication of the electric motor and having the interior configured to transfer the same hydraulic, lubricating fluid to the hydraulic pump for powering the positive displacement oscillating pump;

the hydraulic pump powered by the electric motor, the hydraulic pump configured to draw the hydraulic, lubricating fluid through the interior of the electric motor and to subsequently pump said hydraulic, lubricating fluid into a hydraulic circuit; and the positive displacement oscillating pump being powered by the hydraulic pump and configured to pump the well liquid from the gas well to the outlet.

2. The gas well dewatering system of claim 1, wherein the positive displacement pump is a piston pump and wherein the hydraulic circuit conveys fluid pressure from the hydraulic pump selectively to first and second sides of the piston pump.

3. The gas well dewatering system of claim 2, wherein the piston pump comprises a dual acting piston pump.

4. The gas well dewatering system of claim 2, wherein a switching device is connected to the hydraulic circuit and is switchable between a first position wherein fluid pressure from the hydraulic pump causes the piston pump to move in a first direction and a second position wherein fluid pressure from the hydraulic pump causes the piston pump to move in a second direction.

5. The gas well dewatering system of claim 4, wherein operation of the switching device allows the motor to turn in one direction while the piston pump reciprocates.

6. The gas well dewatering system of claim 4, wherein movement of the piston pump in the first direction causes the switching device to switch to the second position and wherein movement of the piston pump in the second direction causes the switching device to switch to the first position.

7. The gas well dewatering system of claim 4, wherein the piston pump and switching device are coupled together.

8. The gas well dewatering system of claim 7, wherein the switching device comprises a switch body having a first throughbore configured to align with the hydraulic circuit when the switching device is in the first position and a second throughbore configured to align with the hydraulic circuit when the switching device is in the second position.

9. The gas well dewatering system of claim 8, wherein the hydraulic circuit comprises a hydraulic input that aligns with the first throughbore in the switch body when the switch body is in the first position and that aligns with the second throughbore in the switch body when the switch body is in the second position.

10. The gas well dewatering system of claim 8, wherein the hydraulic circuit comprises a first hydraulic output that aligns with the first throughbore when the hydraulic circuit is in the first position and that conveys fluid pressure from the hydraulic pump to the first side of the piston pump and a second hydraulic outlet that aligns with the second throughbore when the hydraulic circuit is in the second position and that conveys fluid pressure from the hydraulic pump to the second side of the piston pump.

11. The gas well dewatering system of claim 8, wherein the piston pump comprises an extension rod configured to engage with the switch body to move the switch body between the first and second positions.

12. The gas well dewatering system of claim 11, wherein the extension rod comprises bottom and top flanges configured to engage with bottom and top sides of the switch body, respectively, to move the switch body between the first and second positions, respectively.

13. The gas well dewatering system of claim 8, comprising at least one dynamic magnet coupled to the switch body and a pair of stationary magnets that are spaced apart and respectively configured to attract the at least one dynamic magnet and thereby attract the switch body into the respective first and second positions.

14. The gas well dewatering system of claim 13, wherein the stationary magnets are coupled to a pump housing containing the piston pump.

15. A gas well dewatering insert having a slender profile, a self-lubricating electric motor, and self-contained hydraulics configured to pump well liquid to an outlet for discharge from the gas well, the gas well dewatering insert comprising:

a reservoir;

an electric motor;

a hydraulic pump to draw a hydraulic lubricating fluid from the reservoir through an interior of the electric motor to a piston pump;

the piston pump for dewatering the gas well;

a hydraulic circuit configured to convey fluid pressure from the hydraulic pump to first and second sides of the piston pump;

a switching device connected to the hydraulic circuit, the switching device being switchable between a first position wherein fluid pressure in the hydraulic circuit is applied to the first side of the piston pump to move the piston pump in a first direction and a second position wherein fluid pressure in the circuit is applied to the second side of the piston pump to move the piston pump in a second, opposite direction;

wherein the movement of the piston pump in the first direction causes corresponding movement of the switching device into the second position, and wherein movement of the piston pump in the second direction causes corresponding movement of the switching device into the first position; and wherein the reservoir, the electric motor, the hydraulic pump, the piston pump, the hydraulic circuit, and the switching device are each secured to form a cylindrical stack having a first diameter substantially smaller than a second diameter of the gas well, the cylindrical stack for insertion into and retrieval from the gas well.

16. The gas well dewatering insert of claim 15, wherein the piston pump and switching device are coupled together.

17. The gas well dewatering insert of claim 16, wherein the switching device comprises a switch body having a first throughbore configured to align with the hydraulic circuit when the switching device is in the first position and a second throughbore configured to align with the hydraulic circuit when the switching device is in the second position.

18. The gas well dewatering insert of claim 17, wherein the hydraulic circuit comprises a hydraulic input that aligns with the first throughbore in the switch body when the switch body is in the first position and that aligns with the second throughbore in the switch body when the switch body is in the second position.

19. The gas well dewatering insert of claim 18, wherein the hydraulic circuit comprises a first hydraulic output that aligns with the first throughbore when the hydraulic circuit is in the first position and that conveys fluid pressure from the hydraulic pump to first side of the piston pump and a second hydraulic outlet that aligns with the second throughbore when the hydraulic circuit is in the second position and that conveys fluid pressure from the hydraulic pump to the second side of the piston pump.

20. The gas well dewatering insert of claim 17, wherein the piston comprises an extension rod configured to engage with the switch body to move the switch body between the first and second positions.

21. The gas well dewatering insert of claim 20, wherein the piston rod comprises bottom and top flanges configured to engage with bottom and top sides of the switch body to move the switch body between the first and second positions, respectively.

22. The gas well dewatering insert of claim 17, comprising at least one dynamic magnet coupled to the switch body and a pair of stationary magnets that are spaced apart and respectively configured to attract the at least one dynamic magnet and thereby attract the switch body into the respective first and second positions.

23. The gas well dewatering insert of claim 22, wherein the stationary magnets are coupled to a pump housing containing the piston pump.

24. The gas well dewatering insert of claim 15, wherein the piston pump comprises a dual acting piston.

25. A gas well dewatering system configured to pump well liquid to an outlet for discharge from the gas well, the gas well dewatering system comprising:

a hydraulic pump;

a dual acting piston pump configured to reciprocate back and forth between first and second directions;

a first hydraulic circuit configured to convey fluid pressure from the hydraulic pump to power the piston pump;

a second hydraulic circuit configured to convey fluid pressure to a non-electric switching device switchable between a first position wherein fluid pressure in the first hydraulic circuit is applied to a first side of the piston pump to move the piston pump in the first direction and a second position wherein fluid pressure in the first hydraulic circuit is applied to a second side of the piston pump to move the piston pump in the second direction;

wherein movement of the piston pump in the first direction causes the non-electric switching device to switch to the second position and wherein movement of the piston pump in the second direction causes the non-electric switching device to switch to the first position; and wherein the hydraulic pump, the dual acting piston pump, the first hydraulic circuit, the second hydraulic circuit, and the non-electric switching device are each secured to form a cylindrical stack having a first diameter substantially smaller than a second diameter of the gas well, the cylindrical stack for insertion into and retrieval from the gas well.

26. The gas well dewatering system of claim 25, further comprising:

a first switch in the second hydraulic circuit, the first switch being switchable between an open position wherein fluid pressure in the first hydraulic circuit is allowed to apply to the first side of the piston pump to move the piston pump in the first direction and a closed position wherein fluid pressure in the first hydraulic circuit is not applied to the first side of the piston pump; and a second switch in the second hydraulic circuit, the second switch being switchable between an open position wherein fluid pressure in the first hydraulic circuit is allowed to apply to the second side of the piston pump to move the piston pump in the second direction and a closed position wherein fluid pressure in the first hydraulic circuit is not applied to the second side of the piston pump.

27. The gas well dewatering system of claim 26, wherein movement of the piston pump in the first direction causes the first switch to move into the closed position, the second switch to move into the open position, and the non-electric switching device to move into the second position; and wherein movement of the piston pump in the second direction causes the first switch to move into the open position, the second switch to move into the closed position, and the non-electric switching device to move into the first position.

28. The gas well dewatering system of claim 27, wherein the first switch comprises a first magnet, the second switch comprises a second magnet and the piston pump comprises a third magnet that is repulsed by the first and second magnets, the repulsive force between the first magnet and the third magnet when the piston pump moves in the second direction moves the first switch into the closed position, and the repulsive force between the second magnet and the third magnet when the piston pump moves in the first direction moves the second switch into the closed position.

29. The gas well dewatering system of claim 28, wherein the third magnet comprises at least two magnets.

30. The gas well dewatering system of claim 29, wherein the piston pump comprises upper and lower piston heads and wherein an upper magnet is coupled to the upper piston head and a lower magnet is coupled to the lower piston head, and further wherein the upper magnet is located proximate the second magnet when the piston moves in the first direction and wherein the lower magnet is located proximate the first magnet when the piston moves in the second direction.

31. The gas well dewatering system of claim 28, wherein the first switch is biased into the closed position and wherein said repulsive force between the first magnet and the third magnet is large enough to overcome the bias and move the first switch into the open position.

32. The gas well dewatering system of claim 31, wherein the second switch is biased into the closed position and wherein said repulsive force between the second magnet and the third magnet is large enough to overcome the bias and move the second switch into the open position.

33. The gas well dewatering system of claim 32, wherein the bias is provided by an elastic element.

34. The gas well dewatering system of claim 32, wherein the non-electric switching device is a sliding spool switch having first and second passages, wherein said first passage aligns with the first hydraulic circuit to connect the hydraulic pump to the first side of the piston pump when the non-electric switching device is in the first position, wherein the second passage aligns with the first hydraulic circuit to connect the hydraulic pump to the second side of the piston pump when the non-electric switching device is in the second position.

35. The gas well dewatering system of claim 31, wherein the bias is provided by an elastic element.

36. The gas well dewatering system of claim 26, wherein the hydraulic pump comprises a single hydraulic pump mechanism for supplying fluid pressure to the first hydraulic circuit and the second hydraulic circuit.

* * * * *